US006648606B2

(12) United States Patent
Sabini et al.

(10) Patent No.: US 6,648,606 B2
(45) Date of Patent: Nov. 18, 2003

(54) CENTRIFUGAL PUMP PERFORMANCE DEGRADATION DETECTION

(75) Inventors: Eugene P. Sabini, Skaneateles, NY (US); Jerome A. Lorenc, Seneca Falls, NY (US); Oakley Henyan, Auburn, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/052,947

(22) Filed: Jan. 17, 2002

(65) Prior Publication Data

US 2003/0133808 A1 Jul. 17, 2003

(51) Int. Cl.[7] ..... F04B 17/00

(52) U.S. Cl. ..... 417/53; 415/1; 415/17; 73/168; 702/113

(58) Field of Search ..... 417/53, 423.1; 415/1, 17, 13–50, 118; 73/168; 702/113, 114

(56) References Cited

U.S. PATENT DOCUMENTS

| | | | | |
|---|---|---|---|---|
| 4,781,525 | A | * 11/1988 | Hubbard et al. | 415/30 |
| 5,307,288 | A | * 4/1994 | Haines | 364/510 |
| 6,330,525 | B1 | * 12/2001 | Hays et al. | 702/183 |
| 2002/0170349 | A1 | * 11/2002 | Soneda et al. | 73/168 |

OTHER PUBLICATIONS

Fernandez et al., May 2002, cep magazine, Understanding the Basics of Centrifugal Pump Operation,pp. 52–56.*

* cited by examiner

*Primary Examiner*—Cheryl J. Tyler
*Assistant Examiner*—John F Belena

(57) ABSTRACT

A method for determining whether a centrifugal pump is degraded as operating outside of acceptable operating limits and includes the steps of determining a motor torque/TDH relationship over a range of speeds for minimum and maximum flow rates and at least at two other intermediate flow rates, sensing and measuring at least another pump value selected from a differential pressure across the pump, a pump discharge pressure or pump flow, to provide an output pump value and comparing said value with said determined relationship values to provide an indication as to whether said pump has degraded.

14 Claims, 2 Drawing Sheets

CENTRIFUGAL PUMP PERFORMANCE DEGRADATION DETECTION

RELATED APPLICATIONS

This application is directly related to entitled, "Pump Operating State without the Use of Traditional Measurement Sensors" filed on Jan. 9, 2002 and having U.S. Ser. No. 10/042,877.

FIELD OF THE INVENTION

This invention relates generally to centrifugal pumps, and, more particularly, to an improved method and apparatus for determining degradation of a centrifugal pump.

BACKGROUND OF THE INVENTION

As is known, a centrifugal pump has a wheel fitted with vanes and known as an impeller. The impeller imparts motion to the fluid which is directed through the pump. A centrifugal pump provides a relatively steady fluid flow. The pressure for achieving the required head is produced by centrifugal acceleration of the fluid in the rotating impeller. The fluid flows axially towards the impeller, is deflected by it and flows out through apertures between the vanes. Thus, the fluid undergoes a change in direction and is accelerated. This produces an increase in the pressure at the pump outlet. When leaving the impeller, the fluid may first pass through a ring of fixed vanes which surround the impeller and is commonly referred to as a diffuser. In this device, with gradually widening passages, the velocity of the liquid is reduced, its kinetic energy being converted into pressure energy. Of course it is noted that in some centrifugal pumps there is no diffuser and the fluid passes directly from the impeller to the volute. The volute is a gradual widening of the spiral casing of the pump. Centrifugal pumps are well known and are widely used in many different environments and applications.

The prior art also refers to centrifugal pumps as velocity machines because the pumping action requires first, the production of the liquid velocity; second, the conversion of the velocity head to a pressure head. The velocity is given by the rotating impeller, the conversion accomplished by diffusing guide vanes in the turbine type and in the volute case surrounding the impeller in the volute type pump. With a few exceptions, all single stage pumps are normally of the volute type. Specific speed $N_s$ of the centrifugal pump is $NQ^{1/2}/H^{3/4}$. Ordinarily, N is expressed in rotations per minute, Q in gallons per minute and head (H) in feet. The specific speed of an impeller is an index to its type. Impellers for high heads usually have low specific speeds, while those for low heads have high specific speeds. The specific speed is a valuable index in determining the maximum suction head that may be employed without the danger of cavitation or vibration, both of which adversely effect capacity and efficiency. Operating points of centrifugal pumps are extremely important.

Several common methods are employed in the prior art to monitor and detect when the centrifugal pump's performance degrades. One such technique operates on the fixed speed pump. The flow and total dynamic head (TDH) is measured when the pump is new. This information is stored as a graph, table or polynomial curve. As the pump ages, the flow and TDH are measured periodically and compared to the new flow and TDH. If the TDH at a given flow drops below a preset percentage, the pump has degraded to a level whereby the pump would have to be either replaced or rebuilt.

A second technique operates on a fixed speed pump. The flow and brake horsepower (BHP) is measured when the pump is new. The information is again stored as a graph, table or polynomial curve. As the pump ages, the flow and BHP are measured periodically and compared to the original flow and BHP. If the BHP at a given flow and the same speed has increased above a preset percentage, the pump and/or motor have degraded to a level that further investigation is needed to determine which rotating piece of equipment is in need on being rebuilt or whether a new pump is necessary. This works well on pumpages whose specific gravity or viscosity does not change in time.

In the third instance, on a variable speed pump, the flow and TDH are measured at several speeds when the pump is new. This information is again stored in a series of graphs, tables or polynomial curves. As the pump ages, the speed, flow and TDH are measured periodically and compared to the original flow and TDH using the Affinity Law to convert the measurements to the nearest speed curve. If the TDH at a given flow drops below a present percentage, the pump has degraded to an undesirable level. This level would indicate that a rebuilt pump is required or that the pump should be replaced.

In regard to the above, it is seen that certain of the methods require that four separate sensing devices (transducers) be purchased and permanently installed on the pump. These devices are to measure suction pressure, discharge pressure, temperature and flow. Therefore, as one can ascertain, the pressure measuring devices are typical pressure transducers, while temperature devices may be temperature sensitive elements, such as thermistors and so on, and flow measuring devices are also well known. The capital expenditures involved in installing and maintaining these sensors are expensive and substantially increase the cost of the unit. In the second method, determining the fixed speed pump operation, that requires the same four transducers or sensor devices utilized to calculate the TDH, but also requires that the pumpage does not change specific gravity or viscosity to cause a change in BHP which is not associated with pump wear.

Thus, as one can ascertain, the prior art techniques are expensive and require the use of additional sensing devices which are permanently installed and become part of the pump.

It is therefore an object of the present invention to provide an improved method and apparatus for detecting degradation performance of a centrifugal pump without employing excessive additional transducer devices.

SUMMARY OF THE INVENTION

The present invention requires the use of a variable speed drive (VSD) for the pump motor. The drive utilized has the ability to characterize the motor to obtain torque supplied by the motor and the actual motor running speed. This feature is provided in most variable frequency drives as presently implemented in today's technology. There is one additional pump sensor required. This sensor measures the differential pressure across the pump, pump discharge pressure or flow. The single additional sensor is also permanently installed with the pump. The apparatus and method clearly requires only one pump transmitter or transducer as opposed to the four required by prior art systems.

BRIEF DESCRIPTION OF THE DRAWINGS

Other aspects, advantages and novel features of the invention will become more apparent from the following detailed description of the invention when considered in conjunction with the accompanying drawings wherein.

DETAILED DESCRIPTION

Figure 1:
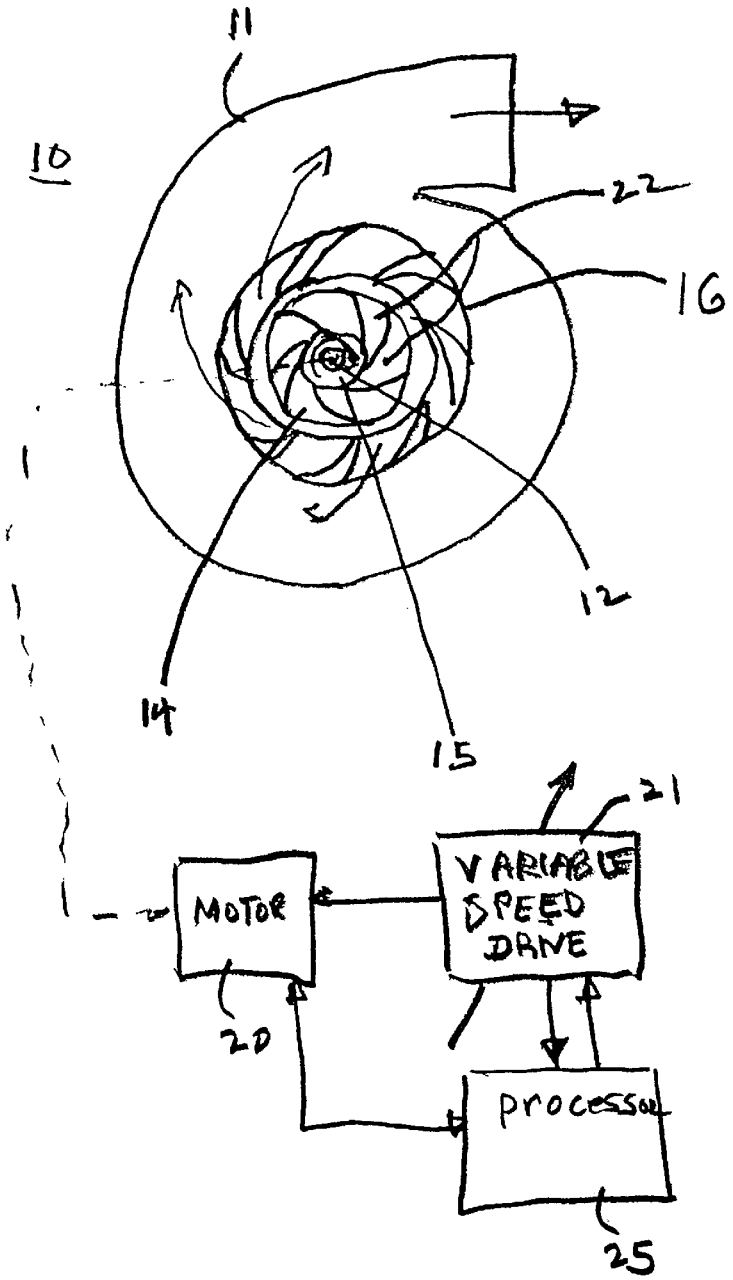
FIG. 1 is a schematic depicting a centrifugal pump driven by a motor having a variable speed drive according to an aspect of this invention.

Referring to FIG. 1, there is shown a schematic view of a typical centrifugal pump 10. The centrifugal pump 10 has a housing 11 which contains a central drive shaft 12. The drive shaft 12 is coupled to and spaced from an impeller member 14. There is a space 15 between the drive shaft 12 and the impeller 14 which allows for the inlet of a fluid or substance to be pumped. The fluid can be water or any other suitable material. As indicated, a centrifugal pump may include a diffuser 16. The diffuser is not necessary and is shown by way of example. As can be seen, the impeller 14 includes a series of blades or vanes and is rotated by means of the drive shaft 12. The drive shaft 12, as seen, is mechanically coupled to a motor 20 which in turn is driven in this particular invention by a variable speed drive apparatus 21.

Essentially, the arrows show the flow of fluid through the centrifugal pump. The centrifugal pump provides a relatively steady flow. The pressure for achieving the required delivery head is produced by centrifugal acceleration of the fluid in the rotating impeller 14. The fluid flows axially towards the impeller, is deflected by the impeller and is discharged through the apertures or spacings 22 between the vanes of the impeller 22. Thus, the fluid experiences a change in direction and is therefore accelerated which produces an increase in pressure at the pump outlet. When the fluid leaves the impeller, the fluid passes through a ring of fixed vanes which surround the impeller and, as indicated, is referred to as a diffuser 16. A diffuser 16 has gradually widening passages where the velocity of the liquid being pumped is reduced. Basically, the diffuser, as indicated, works so that kinetic energy is converted into pressure. This conversion is completed by the volute of the pump which is the gradual widening of the spiral casing. As indicated, some pumps have no diffuser and the fluid passes directly from the impeller to the volute.

In any event, as seen, the centrifugal pump is operated by means of a motor. The output shaft of the motor is coupled to the drive shaft 12. The motor is capable of variable speed drive as controlled by a variable speed drive circuit. Variable drive circuits for motor control are well known and essentially, an adjustable, varying speed motor is one where the speed can be adjusted. Variable speed motors are well known and, for example, motor control can be implemented by many different techniques. There are control circuits which control the speed of the motor which supply a variable width and variable frequency signal which, for example, has a duty cycle and a frequency dependent on the current directed through the motor. Such control devices are implemented using current feedback to sense motor speed. Such circuits can control the speed of the motor by varying the pulse width as well as pulse frequency. Speed control by frequency variation is referred as Variable Frequency Drive (VFD). The entire field of motor control is quite well known. Speed control can be implemented by the use of thyristors or SCR's and in certain situations is analogous to light dimming circuits.

A variable speed or VFD device accurately enables one to calculate the motor speed and torque.

As shown in FIG. 1, there is a processor 25 which essentially may be included in the variable speed drive circuitry 21 and is responsive to motor rotation or torque. The function of the processor, as will be explained, is to solve or process the Affinity Laws governing the operation of centrifugal pumps. It is understood that the processor 25 may contain a microprocessor which would further include a random access memory or other memory means having stored therein the various characteristics of a particular pump. The processor 25 can also control the variable speed drive to enable automatic operation during a test period at different speeds.

The first step in practicing the invention is to obtain the typical hydraulic performance curve for the subject pump. The following formulation is obtained at both the minimum continuous flow and the maximum continuous flow and two intermediate flows for the impeller diameter in the pump speed, TDH, flow and pump efficiency.

The Brake Horsepower (BHP) of the pump is determined at each point using the following equation:

$$BHP = \frac{Q * TDH}{K_1 * n}$$

wherein the variables Q,TDH and n are defined as follows:

"Q" is flow in gallons per minute (gpm)

"TDH" is Total Dynamic Head in feet;

"n" is pump efficiency; and,

"$K_1$"=3960 a unit conversion constant.

The next step is to determine the torque (T) at each operating point using the following equation:

$$T = \frac{BHP * K_2}{N}$$

wherein the variables N and T are defined as follows:

"N" is the pump speed in revolutions per minute (rpm);

"T" is torque in foot-pounds; and,

"$K_2$"=5252 a unit conversion constant.

Using the pump Affinity Laws, the next step is to calculate the Torque and TDH of the pump at several different (slower) speeds for all four flow points:

$$\frac{(N1)}{(N2)} = \frac{(Q1)}{(Q2)} \text{ and } \frac{(N1)\hat{}2}{(N2)\hat{}2} = \frac{(TDH1)}{(TDH2)}$$

where $N_1$ is a first speed; $N_2$ is a second speed; $Q_1$ is the flow at the first speed; $Q_2$ is the flow at the second speed; $TDH_1$ is the total dynamic head at the first speed; and $TDH_2$ is the total dynamic head at the second speed.

Essentially, the pump Affinity Laws are used in the design of testing centrifugal pumps and compressors to predict their performance when the speed of the unit is changed. The laws are:

1. The flow through unit is directly proportional to the speed;
2. The head developed is proportional to the speed squared;
3. The brake horse power is proportional to the speed cubed; and,
4. The efficiency remains approximately constant.

A change in the tip diameter of the impeller will produce approximately the same changes in the performance as a change in speed. Therefore, the Affinity Laws may be used by substituting the outside of the diameter of the impeller for the rotational speed. The use of these laws is well known. The efficiency of the centrifugal pump is directly related to its specific speed and may achieve values of 90 percent or greater. It would be higher if the pump handling large flows and low-pressure rises, and generally will be lower for small flows and high pressures.

Figure 2:
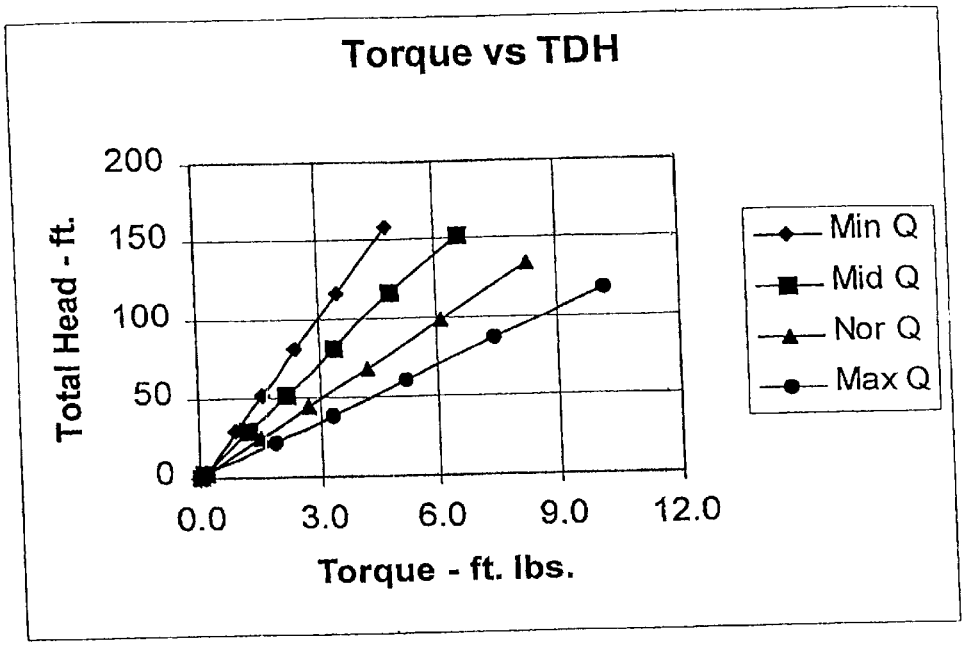
FIG. 2 is a series of graphs depicting torque versus TDH at different flows.
Figure 3:
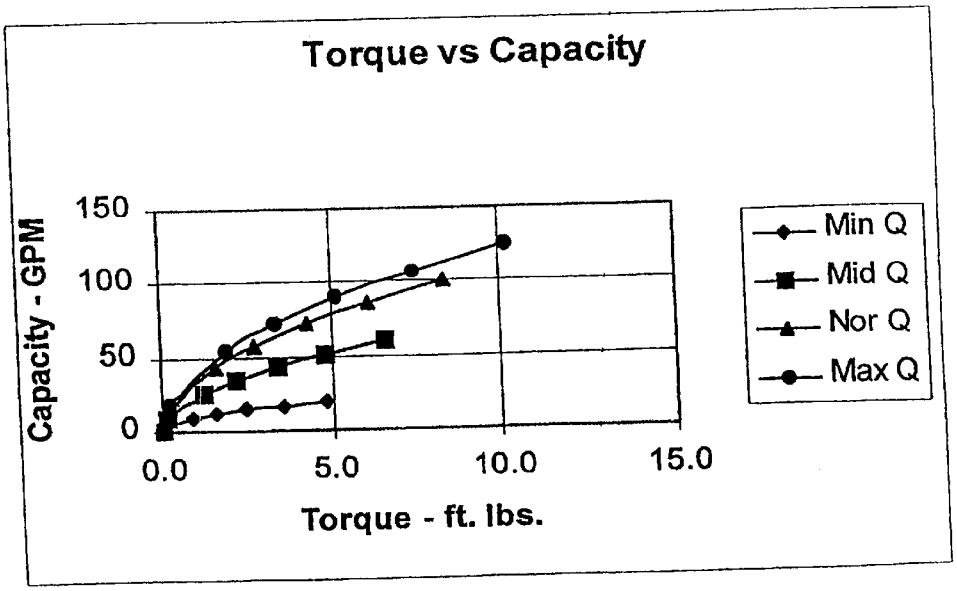
FIG. 3 is a series of graphs depicting torque versus capacity of said different flows.

The data for the four flows is plotted and four lines are constructed as shown in FIGS. 2 and 3. Constant speed points can also be connected. Equations for both the four straight lines and the constant speed curves are formulated. Thus, as seen in FIG. 2, there is shown a graph of the total head TDH versus torque, while FIG. 3 shows a graph of torque versus capacity gallons per minute (GPM) at different speeds. To determine whether the pump/motor has degraded, as indicated above, only one sensor needs to be installed on the pump. This sensor measures the differential pressure across the pump or discharge pressure or flow could also be used. Any one of the three measurements is compared to its expected value based on the speed and torque the motor is producing. If the actual parameter has deviated from the calculated value then the pump is deemed to be degraded to a point that a replacement or a rebuilt pump would be necessary. This, of course, can be all implemented in the processor as shown in FIG. 1.

The data, as shown in FIGS. 2 and 3, can be stored in the processor for each pump, or otherwise be manually provided. It is seen that the cost of providing multiple transducers is eliminated. Thus, as indicated, the above technique is used to determine the loss of performance in a centrifugal pump, eliminating the need for multiple pump sensors. The technique can be employed as a redundant check of any of similar pump devices, thereby further reducing false alarms caused by faulty or disconnected sensors. As one can ascertain, the technique can be used in conjunction with a special purpose processor to automatically solve for pump degradation by the use of the variable speed technique according to this invention.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A method of determining degradation of the performance of a centrifugal pump, the method comprising the steps of:

obtaining, at a first pump speed and a first impeller diameter, the pump's typical, non-degraded maximum continuous flow, minimum continuous flow, and continuous flow at a point between the maximum and minimum continuous flow;

obtaining, at the first pump speed and the first impeller diameter, the pump's typical, non-degraded total dynamic head at each of the flows;

determining brake horsepower at each of the flows and corresponding total dynamic heads;

determining pump torque from each brake horsepower;

determining, at one of a second pump speed and a second impeller diameter, a flow using each of the flows obtained at the first pump speed and first impeller diameter;

determining, at the one of the second pump speed and the second impeller diameter, a total dynamic head using each of the total dynamic heads obtained at the first pump speed, wherein the obtained and determined flows and total dynamic heads define expected performance values of the pump;

measuring an actual pump parameter of the pump at a known torque and a known speed of the pump; and comparing the measured actual pump parameter to the expected performance values of the pump to determine if the measured pump parameter is a deviation from the expected performance values of the pump, the deviation being indicative of the degradation in the performance of the pump.

2. The method according to claim 1, wherein the actual pump parameter measured in the measuring step is differential pump pressure performed by a differential pressure sensor.

3. The method according to claim 1, wherein the actual pump parameter measured in the measuring step is discharge pressure performed by a pressure sensor.

4. The method according to claim 1, wherein the actual pump parameter measured in the measuring step is flow performed by a flow meter.

5. The method according to claim 1, wherein the brake horsepower determining step is performed by computing:

$$BHP = \frac{Q * TDH}{K_1 * n}$$

BHP is the brake horsepower

Q is the flow in gpm,

TDH is the total dynamic head in feet, n is pump efficiency, and, $K_1$ is a constant depending on the unit conversion.

6. The method according to claim 5 wherein the pump torque determining step is performed by computing:

$$T = \frac{BHP * K_2}{N}$$

where T is the pump torque in foot pounds, and, $K_2$ is a constant depending on the unit conversion.

7. The method according to claim 6 wherein the determining steps performed at the one of the second speed and the second impeller diameter are performed by computing:

$$\frac{(N_1)}{(N_2)} = \frac{(Q_1)}{(Q_2)} \frac{(N_1)^2}{(N_2)^2} = \frac{TDH_1}{TDH_2}$$

where $N_1$ is the first speed;

$N_2$ is the one of the second speed and the second impeller diameter;

$Q_1$ is the flow at said first speed;

$Q_2$ is the flow at said second speed;

$TDH_1$ is the total dynamic head at the first speed; and, $TDH_2$ is the total dynamic head at the second speed.

8. A pump apparatus comprising:

a centrifugal pump having an impeller and motor which drives the impeller at a selected pump speed;

a variable speed drive circuit for varying the selected pump speed at which the motor drives the impeller;

a processor;

a memory associated with the processor, the memory storing data arrived at by:

obtaining, at a first pump speed and a first impeller diameter, the pump's typical, non-degraded maximum continuous flow, minimum continuous flow, and continuous flow at a point between the maximum and minimum continuous flow;

obtaining, at the first pump speed the first impeller diameter, the pump's typical, non-degraded total dynamic head at each of the flows;

determining brake horsepower at each of the flows and corresponding total dynamic heads;

determining pump torque from each brake horsepower;

determining, at one of a second pump speed and a second impeller diameter, a flow using each of the flows obtained at the first pump speed and first impeller diameter; and determining, at the one of the second pump speed and the second impeller diameter, a total dynamic head using each of the total dynamic heads obtained at the first pump speed, wherein the obtained and determined flows and total dynamic heads define expected performance values of the pump;

a sensor for measuring an actual pump parameter of the pump at a known torque and a known selected speed of the pump;

wherein the processor compares the measured actual pump parameter to the expected performance values of the pump stored in the memory to ascertain if the measured pump parameter has deviated from the expected performance values of the pump, the deviation being indicative of the degradation in the performance of the pump.

9. The apparatus according to claim 8, wherein the determining steps performed at the one of the second speed and the second impeller diameter are performed by computing:

$$\frac{(N_1)}{(N_2)} = \frac{(Q_1)}{(Q_2)} \frac{(N_1)^{\frac{2}{\lambda}}}{(N_2)^{\frac{2}{\lambda}}} = \frac{TDH1}{TDH2}$$

where $N_1$=the first pump speed;

$N_2$=the one of the second pump speed and the second impeller diameter;

$Q_1$=the flow at said first pump speed;

$Q_2$=the flow at said second pump speed;

TDH1=the total dynamic head at first speed; and

TDH2=the total dynamic head at second speed.

10. The apparatus according to claim 8, wherein the sensor comprises one of a flow sensor and a pump differential transducer.

11. The apparatus according to claim 8, wherein the pump parameter is selected from the group consisting of differential pressure across the pump, discharge pressure, and flow.

12. A pump apparatus comprising:

a centrifugal pump having an impeller and motor which drives the impeller at a selected pump speed;

a variable speed drive circuit for varying the selected pump speed at which the motor drives the impeller;

a processor;

a memory associated with the processor, the memory storing expected performance values of the pump including a brake horsepower of the pump;

a sensor for measuring an actual pump parameter of the pump at a known torque and a known selected speed of the pump;

wherein the processor compares the measured actual pump parameter to the expected performance values of the pump stored in the memory to ascertain if the measured pump parameter is a deviation from the expected performance values of the pump, the deviation being indicative of the degradation in the performance of the pump.

13. A pump apparatus comprising:

a centrifugal pump having an impeller and motor which drives the impeller at a selected pump speed;

a variable speed drive circuit for varying the selected pump speed at which the motor drives the impeller;

a processor; and a sensor for measuring an actual pump parameter of the pump at a known torque and a known selected speed of the pump;

wherein the processor compares the measured actual pump parameter to expected performance values of the pump arrived at by:

obtaining, at a first pump speed and a first impeller diameter, the pump's typical, non-degraded maximum continuous flow, minimum continuous flow, and continuous flow at a point between the maximum and minimum continuous flow;

obtaining, at the first pump speed the first impeller diameter, the pump's typical, non-degraded total dynamic head at each of the flows;

determining brake horsepower at each of the flows and corresponding total dynamic heads;

determining pump torque from each brake horsepower;

determining, at one of a second pump speed and a second impeller diameter, a flow using each of the flows obtained at the first pump speed and first impeller diameter; and determining, at the one of the second pump speed and the second impeller diameter, a total dynamic head using each of the total dynamic heads obtained at the first pump speed;

to ascertain if the measured pump parameter is a deviation from the expected performance values of the pump stored in the memory, the deviation being indicative of the degradation in the performance of the pump.

14. The apparatus according to claim 13, wherein the pump parameter is selected from the group consisting of differential pressure across the pump, discharge pressure, and flow.

* * * * *